United States Patent [19]

Snider

[11] Patent Number: 4,860,896

[45] Date of Patent: Aug. 29, 1989

[54] LOCKING RING FOR ALUMINUM BEVERAGE CANS

[76] Inventor: Keith Snider, 530 So. 98th Way, Mesa, Ariz. 85208

[21] Appl. No.: 191,914

[22] Filed: May 9, 1988

[51] Int. Cl.[4] ..... B65D 67/02; A63H 33/08

[52] U.S. Cl. ..... 206/427; 220/23.4; 220/23.83; 220/85 H; 446/77; 446/125

[58] Field of Search ..... 206/427; 220/85 H, 85 K, 220/96, 23.4, 23.83; 446/75, 77, 115, 116, 124, 127, 901, 125

[56] References Cited

U.S. PATENT DOCUMENTS

| | | | |
|---|---|---|---|
| 3,640,018 | 2/1972 | Light | 446/77 |
| 3,815,281 | 6/1974 | Kander | 446/77 |
| 4,170,082 | 10/1979 | Freedman | 446/115 |
| 4,234,087 | 11/1980 | Pandak | 220/23.4 |
| 4,542,930 | 9/1985 | Adams | 220/23.4 |
| 4,708,684 | 11/1987 | Chen | 446/127 |
| 4,721,222 | 1/1988 | Haythornthwaite | 220/23.4 |
| 4,764,143 | 8/1988 | Gat et al. | 446/127 |
| 4,784,260 | 11/1988 | Holben | 220/23.4 |

FOREIGN PATENT DOCUMENTS

| | | | |
|---|---|---|---|
| 0207709 | 1/1987 | European Pat. Off. | 220/23.83 |
| 2082925 | 3/1982 | United Kingdom | 446/901 |

*Primary Examiner*—Jimmy G. Foster

*Attorney, Agent, or Firm*—Richard R. Mybeck

[57] ABSTRACT

A device for creating imaginative structures from used beverage containers and like cylindrical refuse having an annular belt member having a plurality of axially extending attachment means integrally formed on the outer surface thereof in spaced generally parallel relationship to each other.

2 Claims, 1 Drawing Sheet

LOCKING RING FOR ALUMINUM BEVERAGE CANS

The present invention relates generally to a device for converting refuse into useful things and more particularly to a device for interlocking generally cylindrical beverage cans in vertical and horizontal alignment to create structures therefrom, such as play houses and the like, for the amusement and entertainment of children.

BACKGROUND OF THE INVENTION

Devices have heretofore been proposed to secure beer and pop cans in a vertically stacked arrangement to facilitate storage in small refrigerated or display places. See U.S. Pat. Nos. 2,687,231; 3,885,672; and 4,308,952. Further, an integral arrangement of plastic loops has achieved wide acceptance to horizontally align the traditional "six pack" for marketing and carrying purposes.

Other prior art devices for stacking various objects are shown in U.S. Pat. Nos. 2,734,625 and 2,912,139 but as is apparent from the face thereof, none of these devices are capable of creating the imaginative and entertaining structures made possible by the present invention.

BRIEF SUMMARY OF THE PRESENT INVENTION

The present invention comprises a novel device for creating useful, entertaining and imagination stretching structures from discarded beverage containers such as conventional aluminum pop cans. More particularly, the device comprises a generally annular belt member of about two inches tall with a 8.25 inches inside diameter and having a plurality of axially extending attachment means integrally formed on the outer surface thereof in spaced generally parallel relationship to each other. In a preferred embodiment, each means will be formed of extruded nobs disposed on the ends of discrete shafts mounted in paired assemblies so that the axial center line of each of the assemblies is disposed approximately 45° from the like center line of an adjacent assembly about the perimeter of the belt.

Accordingly, it is a principal object of the present invention to provide a novel and unique device for vertically and horizontally interconnecting a plurality of discarded cylindrical beverage containers into useful, imaginative and highly entertaining objects for child play.

A further object of the present invention is to provide a new and useful device which can be easily manufactured and readily used by unskilled artisans to create imaginative and useful structures and toys for entertaining and amusing small children.

These and still further object as shall hereinafter appear are readily fulfilled by the present invention as can be readily discerned from the following detailed description of exemplary embodiments thereof, especially when read in conjunction with the accompanying drawing in which like parts bear like numerals throughout the several views.

DESCRIPTION OF PREFERRED EMBODIMENTS

Figure 2:
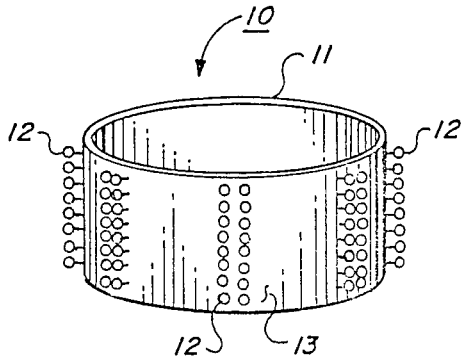
FIG. 2 is an enlarged isometric view of a device embodying the present invention.
Figure 3:
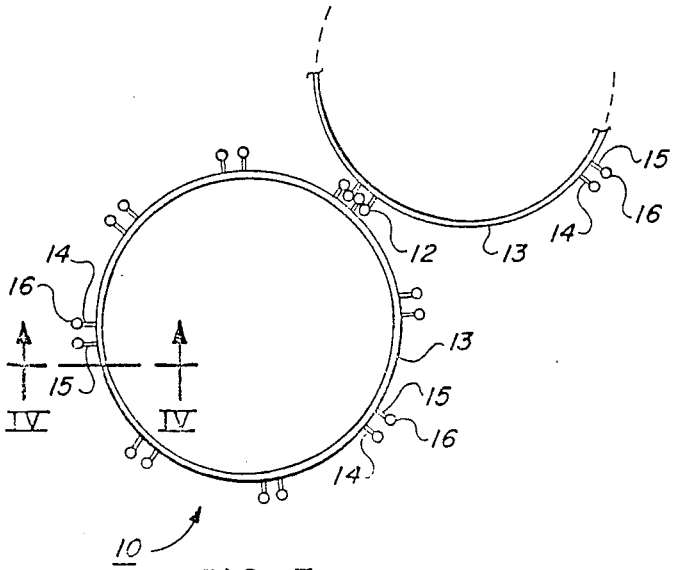
FIG. 3 is a plan elevation partially fragmented, of a pair of interlocked devices in accordance with the present invention.

Referring to the drawing, the device of the present invention is identified by the general reference 10. As shown in FIG. 2, each device 10 comprises a generally annular belt member 11 having a plurality of axially extending attachment means 12 integrally formed on the outer surface 13 of belt member 11 in spaced generally parallel relationship to each other and disposed in such a manner that the axial center lines of adjacent attachment means 12 are disposed approximately 45°-90° apart from each other on and relative to the perimeter of belt member 11.

Each attachment means 12 comprises a first row 14 of radially extending pin or shaft members, and a second row 15 of radially extending pin or shaft members, the rows 14, 15 being disposed in spaced generally parallel relationship to each other. A plurality of ball-like members 16 are disposed on the outer edge of each pin member 17 to create rows 14 and 15 which are so spaced to permit the locking engagement therebetween of corresponding ball-like members 16 carried by another device 10 which is disposed operatively adjacent thereto.

Figure 1:
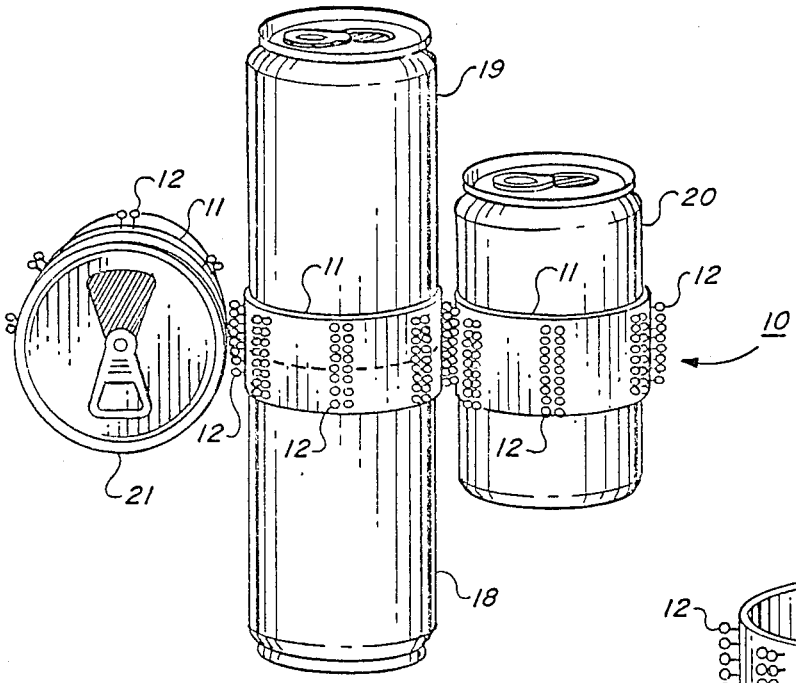
FIG. 1 is an isometric showing of a partial structure constructed in accordance with the present invention.
Figure 4:
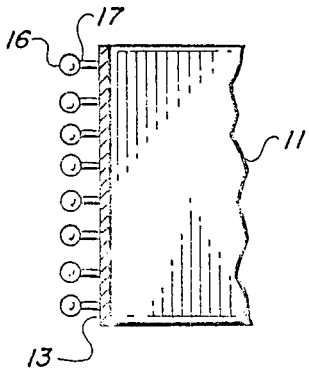
FIG. 4 is a cross-section taken on line IV—IV of FIG. 3.

In use, as shown in FIGS. 1,2 and 4, a device 10 is disposed in partial circumscription upon and about the upper portion of a first can 18 and is similarly disposed relative to the lower portion of a second can 19 so that cans 18 and 19 are preferably in abutting relationship to each other and create a vertical stack. Similar devices 10 can be disposed on the remote ends of cans 18 and 19 to permit still further stacking of other cans joined thereto until a structure of desired height is created. A similar vertical stack is identified at 20. A horizontally disposed can 21 can be secured to the side of the first stack 20 by the engagement of the corresponding attachment means 12, 12 with each other. The procedure can be repeated as many times as necessary until the desired width is created. Windows and doorways are readily created by omitting the placement of cans in those spaces where such openings are desired.

In this fashion, the device 10 can be used to lock pop cans together, both end to end and side to side. By doing so, children or their care providers can create cars, trucks, boats, ships, airplanes, rockets, play houses and other items limited only by the creator's imagination.

In a preferred practice of the present invention, device 10 can be molded or extruded from polyvinyl chloride or like semi-rigid but relatively inexpensive plastic materials. Cans are readily obtainable from local garbage dump or recycling center or from the consumer's own collections in cooperation with one or more neighbors. Of course, should there ever become a shortage of aluminum or steel pop cans, which at this moment is considered remote, aluminum or other metallic cylinders resembling pop cans can be manufactured for specific use in the practice of this invention.

In one alternative embodiment of the present invention, the several pin members 17 making up first row 14 and second row 15 may be cast as a unitary flange member, which with a plurality of ball like members 16 uniformly disposed thereupon or with a contiguous curvilinear flange cast therewith to have a diameter of comparable dimension to said ball member 16, the unique results described therefor can also be obtained.

From the foregoing, it becomes apparent that new and useful procedures have been herein described and illustrated which fulfill all of the aforestated objectives in a remarkably unexpected fashion. It is of course understood that such modifications, alterations and adaptations as may readily occur to an artisan having the ordinary skills to which this invention pertains are intended within the spirit of the present invention which is limited only by the scope of the claims appended hereto.

What is claimed is:

1. A locking ring for creating imaginative structures from used beverage cans comprising an annular belt member having a plurality of axially extending attachment means formed on the perimeter thereof in uniformly spaced relationship to each other, each of said attachment means comprising a first row of spaced radially extending pin-like members having a ball-like member disposed on the outer end thereof and a second row of spaced radially extending pin-like members having a ball-like member disposed on the outer end thereof, said first row and said second row being disposed in spaced generally parallel relationship to each other with said space being less than the diameter of said ball-like member.

2. A locking ring for creating imaginative structures from used beverage cans comprising an annular belt member having a plurality of axially extending attachment means formed on the perimeter thereof in uniformly spaced relationship to each other, each of said attachment means comprising a first and second axially extending flange members disposed on the outer surface of said belt member in spaced generally parallel relationship to each other, each said flange member having a curvilinear enlargement in the outer edge thereof having a diameter sufficiently larger than the space between corresponding enlargements to be lockingly engaged thereby when inserted therebetween.

* * * * *